US010299595B2

(12) United States Patent
Diffrient et al.

(10) Patent No.: US 10,299,595 B2
(45) Date of Patent: May 28, 2019

(54) CHAIR WITH ARTICULATING BACKREST

(71) Applicant: Humanscale Corporation, New York, NY (US)

(72) Inventors: Niels Diffrient, Ridgefield, CT (US); James Sortor, New Fairfield, CT (US); Shaun Smith, Harleysville, PA (US); Mesve Vardar, New York, NY (US); Jeff Theesfeld, East Greenville, PA (US); Cory Brechbill, East Greenville, PA (US)

(73) Assignee: HUMANSCALE CORPORATION, New York, NY (US)

( * ) Notice: Subject to any disclaimer, the term of this patent is extended or adjusted under 35 U.S.C. 154(b) by 0 days.

(21) Appl. No.: 15/619,183

(22) Filed: Jun. 9, 2017

(65) Prior Publication Data

US 2017/0354254 A1 Dec. 14, 2017

Related U.S. Application Data

(60) Provisional application No. 62/348,886, filed on Jun. 11, 2016.

(51) Int. Cl.
*A47C 1/024* (2006.01)
*A47C 7/46* (2006.01)
(Continued)

(52) U.S. Cl.
CPC ..... *A47C 1/024* (2013.01); *A47C 3/026* (2013.01); *A47C 7/44* (2013.01); *A47C 7/462* (2013.01)

(58) Field of Classification Search
CPC ..... A47C 1/024; A47C 7/405; A47C 7/44; A47C 7/462
See application file for complete search history.

(56) References Cited

U.S. PATENT DOCUMENTS 5,975,634 A 11/1999 Knoblock et al.
6,523,898 B1 2/2003 Ball et al.
(Continued)

FOREIGN PATENT DOCUMENTS

EP 0815778 A1 1/1998

OTHER PUBLICATIONS

Adsausage, Knoll, The Diffrient Executive Chair, Jun. 9, 2016, 2 pages.

(Continued)

*Primary Examiner* — Philip F Gabler
(74) *Attorney, Agent, or Firm* — Jones Walker LLP

(57) ABSTRACT

A chair having an articulating backrest that deforms when reclined to support an occupant's head or shoulders. A backrest assembly includes a mesh insert secured to a frame, which includes an upper frame section and a lower frame section interconnected by a pair of articulated joints. A push arm pivotally connects to the chair's seat assembly and to the backrest's upper frame section. As the chair reclines, the push arm restricts the angular movement of the upper frame section relative to a floor. The lower frame section moves forward relative to the upper frame section. Consequently, an angle formed between the lower frame section and the upper frame section decreases during recline, thereby supporting the chair occupant's head or shoulders. Optionally, a tensioning member may connect the mesh insert to the push arm to offset any loss of tension caused by the deformation of the frame during reclined.

24 Claims, 13 Drawing Sheets

(51) Int. Cl.
*A47C 3/026* (2006.01)
*A47C 7/44* (2006.01)

(56) References Cited

U.S. PATENT DOCUMENTS

| | | | | |
|---|---|---|---|---|
| 7,396,079 | B2 * | 7/2008 | Heidmann | A47C 7/405 297/284.4 |
| 7,712,833 | B2 * | 5/2010 | Ueda | A47C 1/03255 297/296 |
| 7,862,120 | B2 * | 1/2011 | Ueda | A47C 1/03255 297/285 |
| D713,664 | S | 9/2014 | Vetter et al. | |
| 9,700,138 | B2 * | 7/2017 | Rechtien | A47C 1/024 |
| D795,622 | S * | 8/2017 | Diffrient | D6/716.4 |
| 10,028,586 | B2 * | 7/2018 | Schneider | A47C 1/03255 |
| 2002/0180248 | A1 * | 12/2002 | Kinoshita | A47C 1/023 297/284.1 |
| 2002/0195863 | A1 | 12/2002 | Su | |
| 2003/0107252 | A1 | 6/2003 | Kinoshita et al. | |
| 2007/0001497 | A1 * | 1/2007 | Diffrient | A47C 1/03255 297/321 |
| 2007/0108822 | A1 | 5/2007 | Ueda | |
| 2013/0082499 | A1 | 4/2013 | Schmitz et al. | |
| 2015/0265052 | A1 | 9/2015 | Gehner et al. | |
| 2017/0354254 | A1 * | 12/2017 | Diffrient | A47C 7/462 |

OTHER PUBLICATIONS

Knoll, Inc., Generation by Knoll brochure, 2009, 18 pages.
Knoll, Inc., ReGeneration by Knoll brochure, 2012, 8 pages.
Dauphin Furniture, Lordo brochure, 2009, 6 pages.
Steelcase, Inc., Steelcase brochure, 2015, 8 pages.
2ndhnd.com, Steelcase Please Chair With Grey Frame, website screen shots, 2016, 4 pages.
PCT/US2017/036846, USPTO as ISA, Search Report and Written Opinion dated Aug. 21, 2017, 8 pages.
Herman Miller Chair, http://decobizz.com/best/best-rated_ergonomic_office_chairs.html, known at least as early as May 27, 2016, 2 pgs.
Diffrient Smart Chair, https://www.humanscale.com/products/product.cfm?group=DiffrientSmartChair, known as least as early as Jun. 7, 2016, 1 pg.

* cited by examiner

CHAIR WITH ARTICULATING BACKREST

CROSS-REFERENCE TO RELATED APPLICATIONS

This application claims the benefit of U.S. Provisional Application No. 62/348,886, filed Jun. 11, 2016, which is incorporated herein in its entirety by reference.

BACKGROUND

Mesh office chairs, which utilize a membranous fabric stretched across a component frame, offer a number of advantages over upholstered chairs. The mesh design enables airflow to keep the occupant cool as they sit and work. Along with breathability, mesh chairs are quite durable and require minimal maintenance.

Despite these advantages, mesh chairs do present challenges when attempting to provide the occupant with the appropriate ergonomic support. Efforts have been made to provide the benefits of a mesh backrest in a chair while still providing the occupant with the appropriate ergonomic support in the lumbar region. For example, ergonomic lumbar support has been accomplished through the use of a separate structural brace positioned behind the mesh in the occupant's lumbar region. Contoured mesh panels, such as those described in U.S. Pat. No. 8,240,771, have also been developed to provide a mesh backrest having lumbar support without the necessity of an additional solid structure. Heretofore, however, manufacturers have been unable to provide a unitary mesh backrest capable of providing the chair occupant adequate shoulder support or headrest support when the chair is in the reclined state.

SUMMARY

Traditional mesh chairs utilize a rigid backrest frame to maintain the mesh panel's tension throughout the chair's range of motion. However, because the backrest frame is rigid, the backrest's shoulder and headrest portions maintain their positions relative to the lumbar portion as the chair is reclined, thus providing very little support to the occupant's head or shoulders in the reclined state. The invention disclosed herein is directed to a mesh chair having an articulating backrest capable of supporting an occupant's head or shoulders as the chair is reclined. Whereas traditional mesh chairs utilize a rigid backrest frame, a mesh chair embodying principles of the present invention features an articulating backrest frame that deforms as the chair is reclined.

In a particular embodiment exemplifying the principles of the invention, the mesh chair can comprise a backrest assembly having a mesh insert secured to a frame. The frame can comprise a rigid upper frame section and a rigid lower frame section interconnected by a pair of articulated joints. In order to cause the frame to deform as the chair is reclined, a push arm is utilized. The push arm pivotally connects to the backrest's upper frame section and to the chair's seat assembly. As the mesh chair is reclined, the push arm will restrict the movement of the backrest's upper frame section, thereby causing the upper frame section to remain in substantially the same angular position relative to a floor. The lower frame section will move forward relative to the upper frame section (i.e., the angle formed between the upper frame section and the lower frame section will decrease) in the reclined state. By causing the upper portion of the backrest to remain in substantially the same angular position and by moving the lower portion of the backrest forward in the reclined state, the chair of the present invention will more closely mirror the occupant's ideal, ergonomic posture when in the reclined state, thus providing improved lumbar support and improved shoulder and/or head support.

By virtue of the articulated joints connecting the backrest's upper frame section to the lower frame section, the frame may deform as the mesh chair is reclined, thus negatively impacting the tension being imparted on the mesh insert by the frame. In order to offset the loss of tension caused by the frame deforming, a mesh chair embodying features of the present invention can further comprise one or more tensioning members connecting the mesh insert to the push rod. In this arrangement, the one or more tensioning members will supply tension to the mesh insert and offset at least a portion of the tension lost as a result of the frame deforming in the reclined state.

The above summary is not intended to describe each illustrated embodiment or every possible implementation. These and other features, aspects, and advantages of the present invention will become better understood with regard to the following description, appended claims, and accompanying drawings.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages in accordance with the present invention.

DETAILED DESCRIPTION OF SELECTED EMBODIMENTS

Figure 1A:
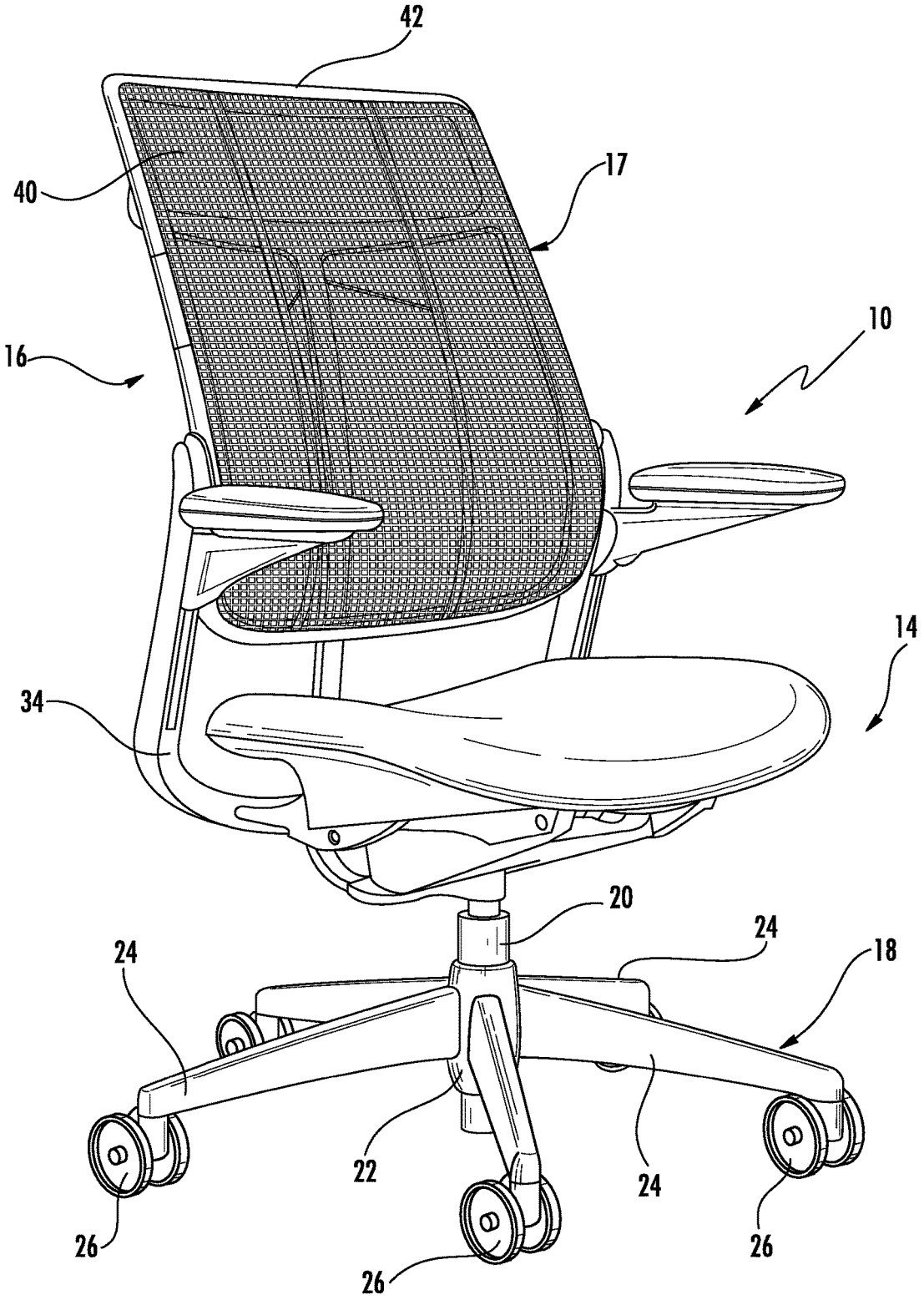
FIG. 1A is a perspective view of an embodiment of a chair having an articulating backrest in the upright position.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Relational terms such as first and second, top and bottom, right and left, and the like may be used solely to distinguish one entity or action from another entity or action without necessarily requiring or implying any actual such relationship or order between such entities or actions.

Described now are exemplary embodiments of the present invention. With reference to FIGS. 1A-1E, an exemplary embodiment of the mesh chair 10 having an articulating backrest is depicted. The mesh chair 10 may include a backrest assembly 16 mounted to a seat assembly 14. The mesh chair of the present invention can utilize any one of a variety of seat assemblies 14 known in the art. For example, as depicted in FIGS. 1A-1E, the seat assembly 14 may include a pedestal 18 supporting a seat support 32 and an attached seat 30. The pedestal 18 may have a central extension rod 20 slidingly disposed through central housing 22. Leg members 24 may extend from central housing 22. Pedestal 18 may include any number of leg members 24 for supporting the seat assembly 14. For example, pedestal 18 may include between three and ten leg members 24. Casters 26 may be attached to a distal end of each leg member 24 of pedestal 18. The seat support 32 may be connected to an upper end of central extension rod 20 of pedestal 18. The height of the seat 30 may be adjustable by any height adjustment mechanism known in the art. For example, the actuation of control 33 on the seat support 32 may allow the central extension rod 20 to slide within the central housing 22 of the pedestal 18. The releasing of control 33 may lock the central extension rod 20 in a selected position within the central housing 22 to set the height of the seat 30. The seat assembly 14 may also house a recline resistance mechanism (not shown) operatively coupled to the backrest assembly 16, such as a traditional mechanical spring or gas cylinder, or a self-adjusting recline resistance mechanism such as those disclosed in U.S. Pat. Nos. 6,709,058 and 8,777,312, the entireties of which are incorporated herein by reference. In alternative embodiments, and as readily understood by one skilled in the art, the seat assembly 14 may utilize any chair base mechanism capable of supporting the seat 30. For example, in further embodiments, the mesh chair 10 can be a four-legged chair, with the seat 30 being attached to the leg supports. The seat 30 may be a mesh seat, an upholstered seat, or any other seat known in the art.

Still referring to FIGS. 1A-1E, the backrest assembly 16 is preferably connected to the seat assembly 14 in a manner allowing the backrest assembly 16 to pivot rearwardly relative to the seat assembly 14. The backrest assembly 16 may include a backrest 17 pivotally connected to a backrest support 34. In the embodiment depicted in FIGS. 1A-1E, the backrest support 34 has a lower end 35 pivotally attached to seat support 32. The pivotal connection between the lower end 35 and the seat support 32 may provide for pivotal movement of the backrest support 34 relative to the seat support 32, resulting in the upper end of the backrest support 34 moving in a rearward direction when the mesh chair 10 is reclined. Optionally, arm assemblies 36 may be attached to the backrest support 34. Backrest support 34 may be formed of metal, hard plastic, wood, or composite material (such as, but not limited to, fiber glass or carbon fiber).

The backrest 17 may include a unitary mesh insert 40 surrounded by a unitary frame 42. The mesh insert 40 can be made from any conventional membranous fabric, such as nylon, polyester, or other synthetic or natural fibers or skins. The unitary mesh insert 40 may be a single expanse of fabric, or the unitary mesh insert 40 may include multiple mesh panels connected by one or more seams. For example, the mesh insert 40 may include a first mesh panel 44, a second mesh panel 46, and a third mesh panel 48. A first seam 50 can connect the first and second mesh panels 44 and 46, while a second seam 52 can connect the second and third mesh panels 46 and 48. The mesh panels may have various shapes, including but not limited to, the generally rectangular shapes shown in FIG. 1C.

The membranous mesh material can be attached to the frame 42 by any conventional method. One preferred method is by attaching the material, such as by welding or gluing, to a flexible strip, such as a spline, and fitting the combination into a grove formed in the frame 42. In one particular embodiment, the mesh material is sewn to a spline. The combination is generally fitted into the groove at a right angle to the direction of the tension on the material. The flexible strip used in attaching the material to the frame 42 can be made from any material commonly known for such uses, and is desirably a plastic-type extrusion, such as polyethylene or an equivalent.

The frame 42 may include a rigid upper frame section 56 and a rigid lower frame section 58 interconnected by a pair of articulated joints 60 to form a unitary frame. The articulated joints 60 allow the lower frame section 58 to move independent of the upper frame section 56. In the embodiment depicted in FIGS. 1-8, the articulated joints 60 comprise a pair of flexible connectors. Each flexible connector 60 may be attached to a lower end of upper frame section 56 and attached to an upper end of the lower frame section 58. In order to cause the frame 42 to deform as the mesh chair 10 is reclined, a push arm 68 is utilized. As shown in FIGS. 1B-1E, 6, and 7, the push arm 68 pivotally connects to both the backrest's upper frame section 56 and the seat assembly 14. The push arm 68 may extend in a generally vertical direction from upper end 70 to lower end 72. In the embodiment depicted in FIGS. 1-8, the upper end 70 of the push arm 68 is connected to the upper backrest brace 74 of the upper frame section 56. The lower end 72 of the push arm 68 can be pivotally connected to the seat support 32.

Figure 1B:
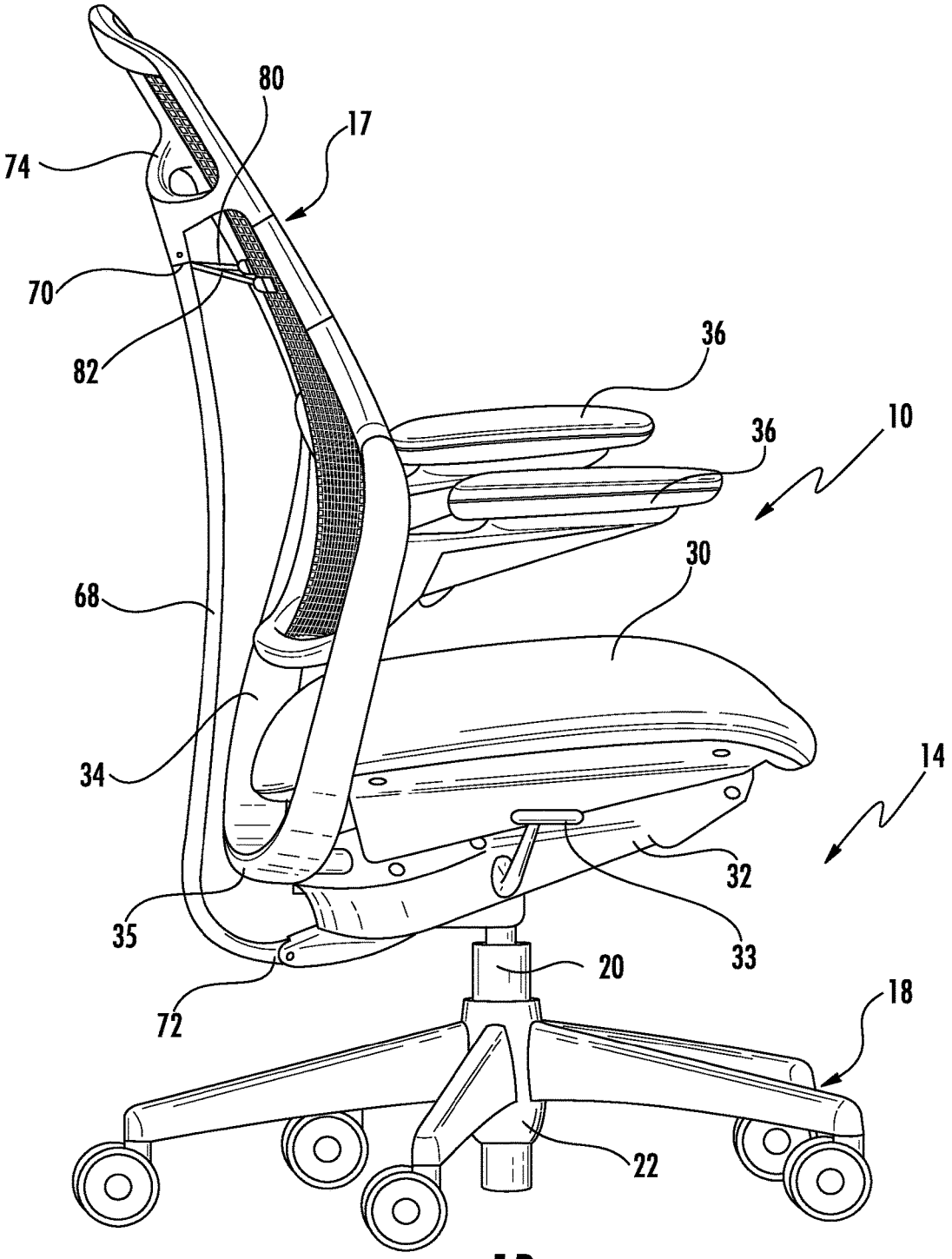
FIG. 1B is a side view of the embodiment of the chair shown in FIG. 1A.
Figure 1C:
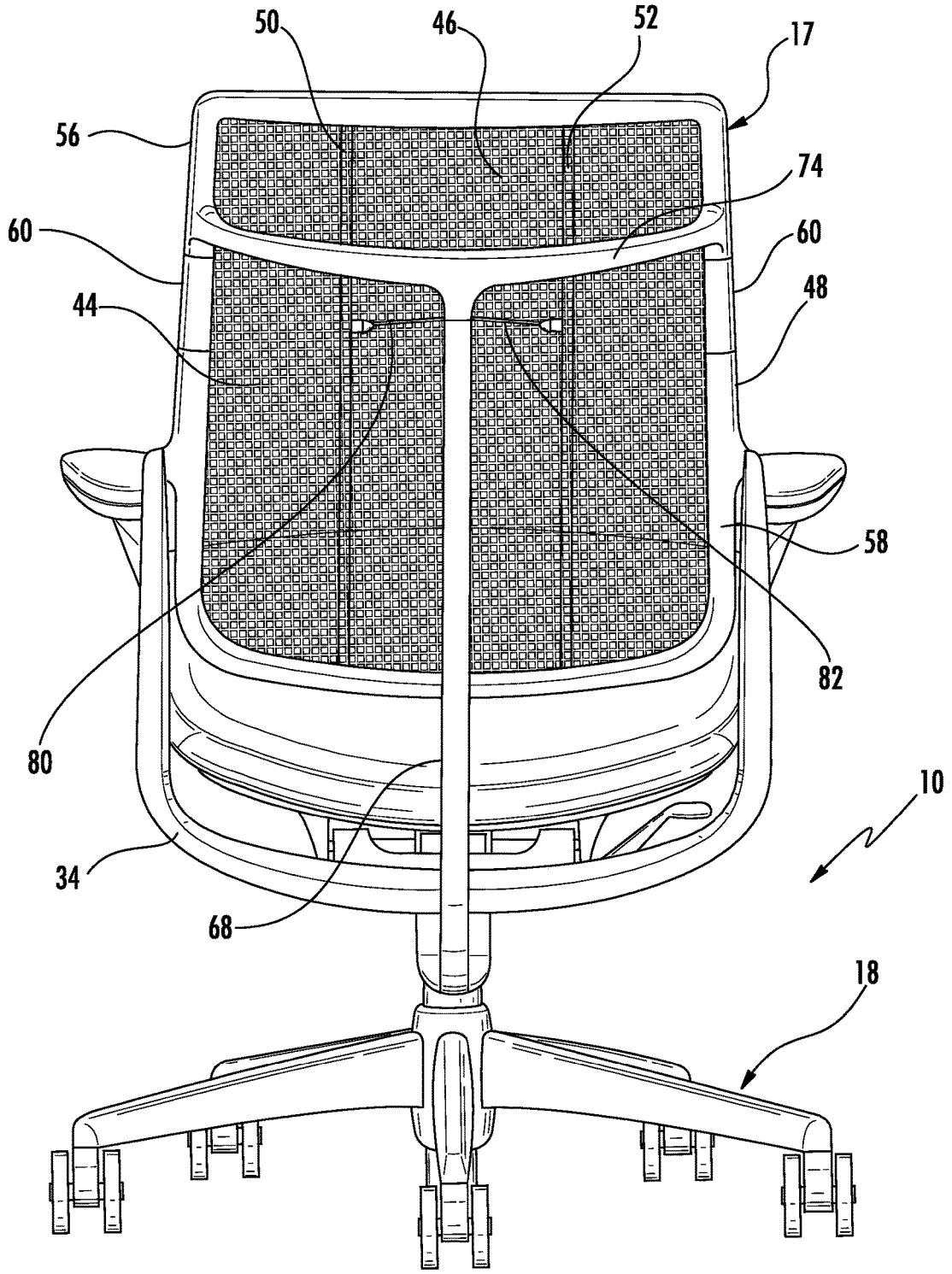
FIG. 1C is a rear view of the embodiment of the chair shown in FIG. 1A.
Figure 1D:
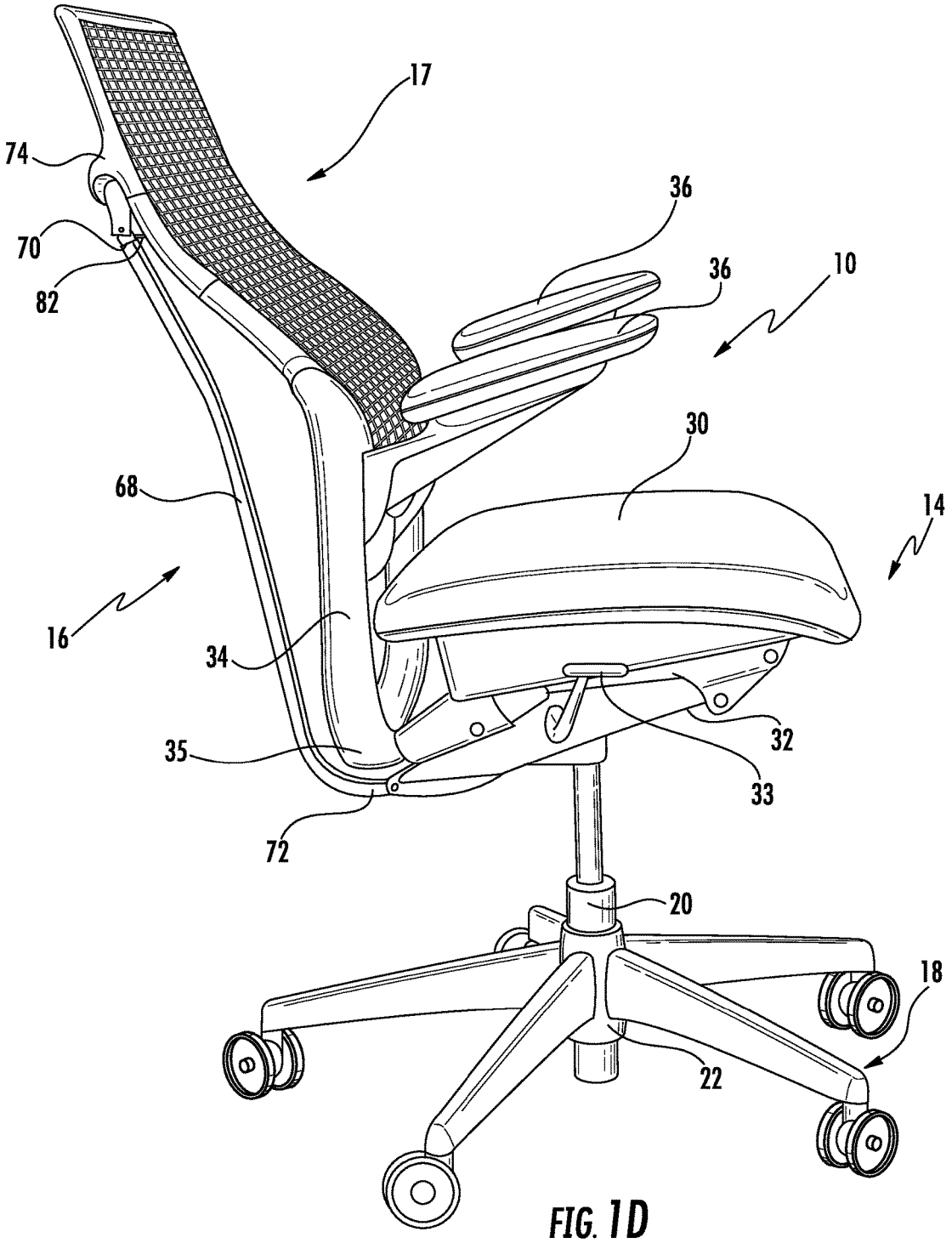
FIG. 1D is a side view of the embodiment of the chair shown in FIG. 1A, with the chair being in the reclined position.
Figure 1E:
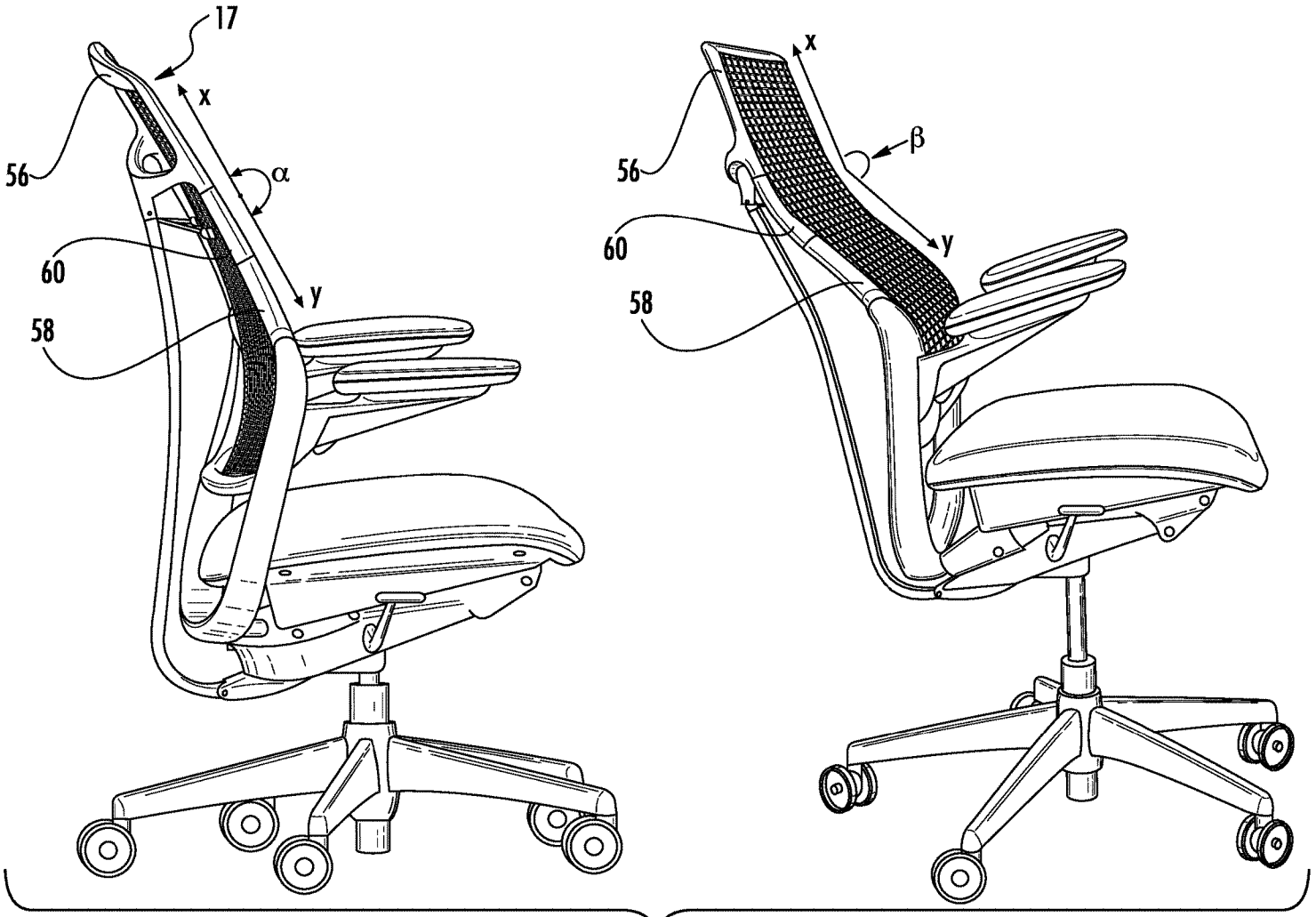
FIG. 1E is a comparison of the chair in the upright position shown in FIG. 1B and the chair in the reclined position shown in FIG. 1D.
Figure 2:
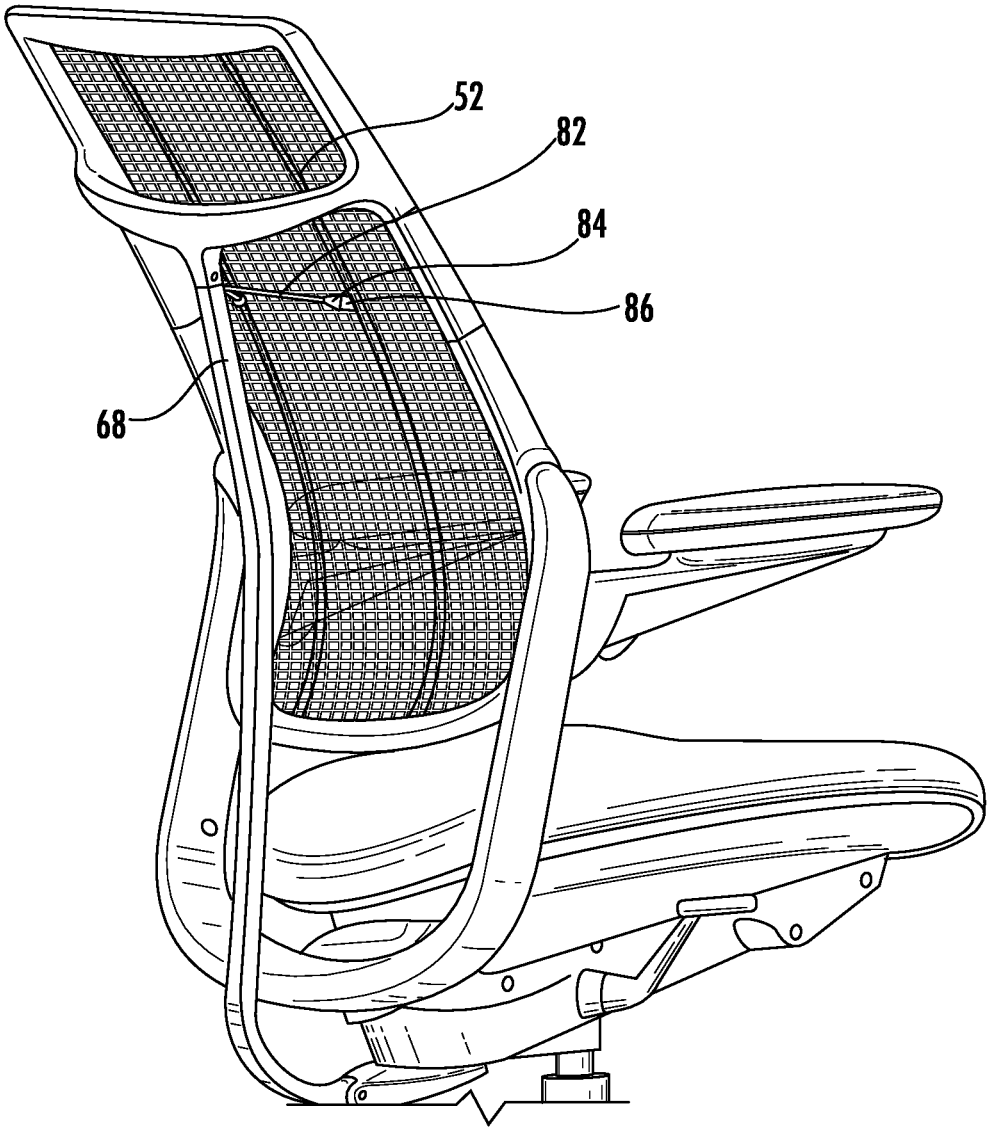
FIG. 2 is a perspective view showing an embodiment of a tensioning member suitable for use with the chair shown in FIG. 1.
Figure 3:
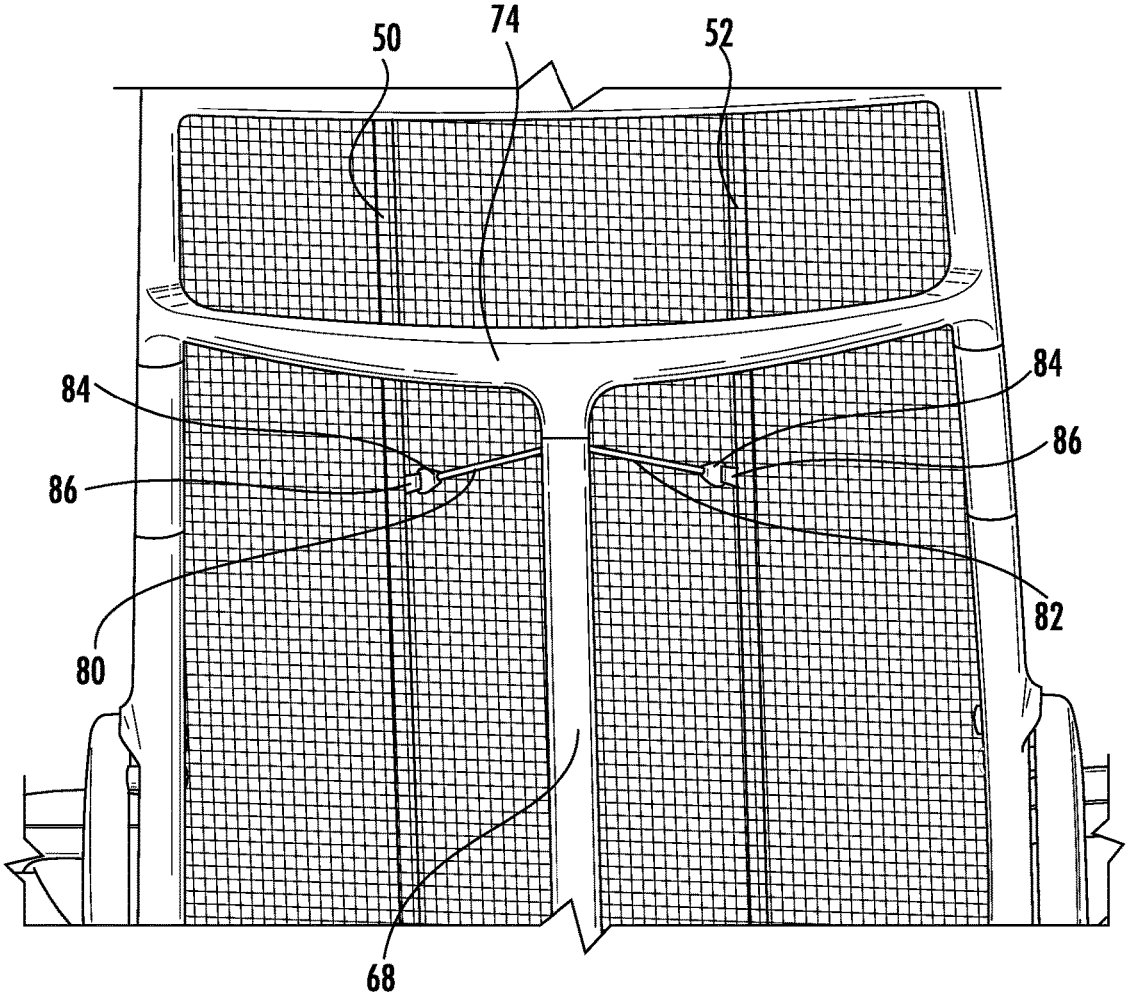
FIG. 3 is a rear view an embodiment of a pair of tension members suitable for use with the chair shown in FIG. 1.

In the upright position shown in FIG. 1B, the lower frame section 58 is positioned at angle α relative to the upper frame section 56 as illustrated in FIG. 1E. This angle is measured by the intersection of a line substantially parallel to the upper frame section and a line substantially parallel to the lower frame section. For purposes of this disclosure, "substantially parallel" means a line that deviates from the angle of the upper or lower frame section by 5 degrees or less along the entire length of the frame section.

In one embodiment, the lower frame section 58 and the upper frame section 56 are co-planar such that angle α is approximately 180 degrees. In other embodiments, angle α may be less than 180 degrees. In the upright position, an angular position of the upper frame section 56 may be tilted by 45-75 degrees relative to the floor. Preferably, the angular position of the upper frame section 56 may be 50-70 degrees. More preferably, the angular position of the upper frame section 56 may be 55-65 degrees. Most preferably, the angular position of the upper frame section 56 may be 58-62 degrees.

As the mesh chair 10 is reclined, the push arm restricts the movement of the upper frame section 56, thereby causing the upper frame section 56 to remain in substantially the same angular position relative to the floor as in the chair's upright position (shown in FIG. 1D). For purposes of this disclosure, "substantially the same angular position" means an angular position that changes by 5 degrees or less between the upright position and the reclined position. In some embodiments, the upper frame section 56 has a change in angular position of 4 degrees or less relative to the floor as in the chair's upright position. In another embodiment, the upper frame section 56 has a change in angular position of 3 degrees or less relative to the floor as in the chair's upright position. The lower frame section 58 will move forward relative to the upper frame section 56 in the reclined state, thereby providing improved lumbar support. In one embodiment, the lower frame section 58 may rotate by 15-35 degrees relative to the floor when the chair is reclined. Preferably, the lower frame section 58 may rotate by 20-30 degrees relative to floor when the chair is reclined. More preferably, the lower frame section 58 may rotate by 24-28 degrees relative to the floor when the chair is reclined. Consequently in the reclined position, angle β between the lower frame section 58 and the upper frame section 56 is less than angle α as illustrated in FIG. 1E. In other words, the angle between the lower frame section 58 and the upper frame section 56 decreases during recline.

In the reclined position shown in FIG. 1D, the upper frame section 56 supports the chair occupant's head or shoulders. In one embodiment, the upper frame section 56 touches the chair occupant's shoulders without touching his or her head. Because the occupant's shoulders remain vertical and supported when the chair is reclined, this natural supportive position of the shoulders supports the head. In another embodiment, the upper frame section 56 contacts the chair occupant's head in order to provide headrest support when the chair is in the reclined state.

The upper and lower frame sections 56 and 58 may be formed of any metal, plastic, wood, or composite material (such as, but not limited to, fiber glass or carbon fiber). The push arm 68 may be formed of any metal, plastic, wood, or composite material (such as, but not limited to, fiber glass or carbon fiber).

The frame 42 will deform as the mesh chair 10 is reclined, thus negatively impacting the tension being imparted on the mesh insert 40 by the frame 42. One or more tension members may be attached to mesh insert 40 and push arm 68 in order to maintain tension in the mesh insert 40 when the mesh chair 10 is reclined. As shown in more detail in FIGS. 2 and 3, in one embodiment, there are two tension members 80 and 82 that each comprise a tension cord, such as a stretch or non-stretch cable or cord made of nylon, any of the mesh materials described above, any thread or polymer string, and/or any metal, such as braided steel. For example, tension members 80 and 82 in the embodiment of FIGS. 2 and 3 may be formed of a shock cord in one embodiment. One end of each tension member 80, 82 may be attached to either the push arm 68 or the upper frame section's backrest brace 74. The other ends of the tension members may be attached to the mesh insert 40, respectively, using the strap 86 and connector 84. For example, the second ends of the tension members may be attached to seams 50, 52.

Figure 4:
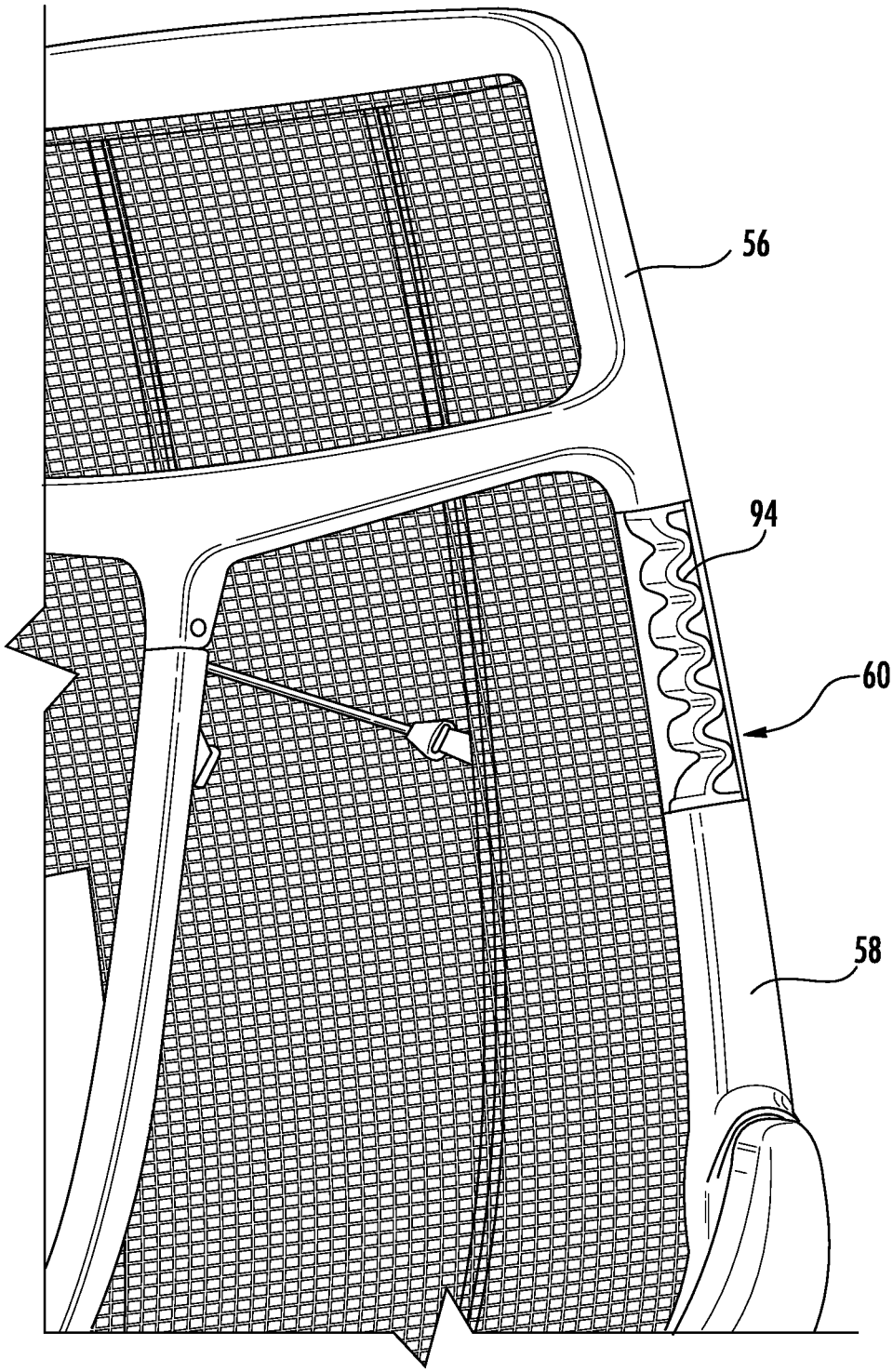
FIG. 4 is a perspective view of the embodiment of the chair shown in FIG. 1 with the outer housing of the flexible connector removed.
Figure 5A:
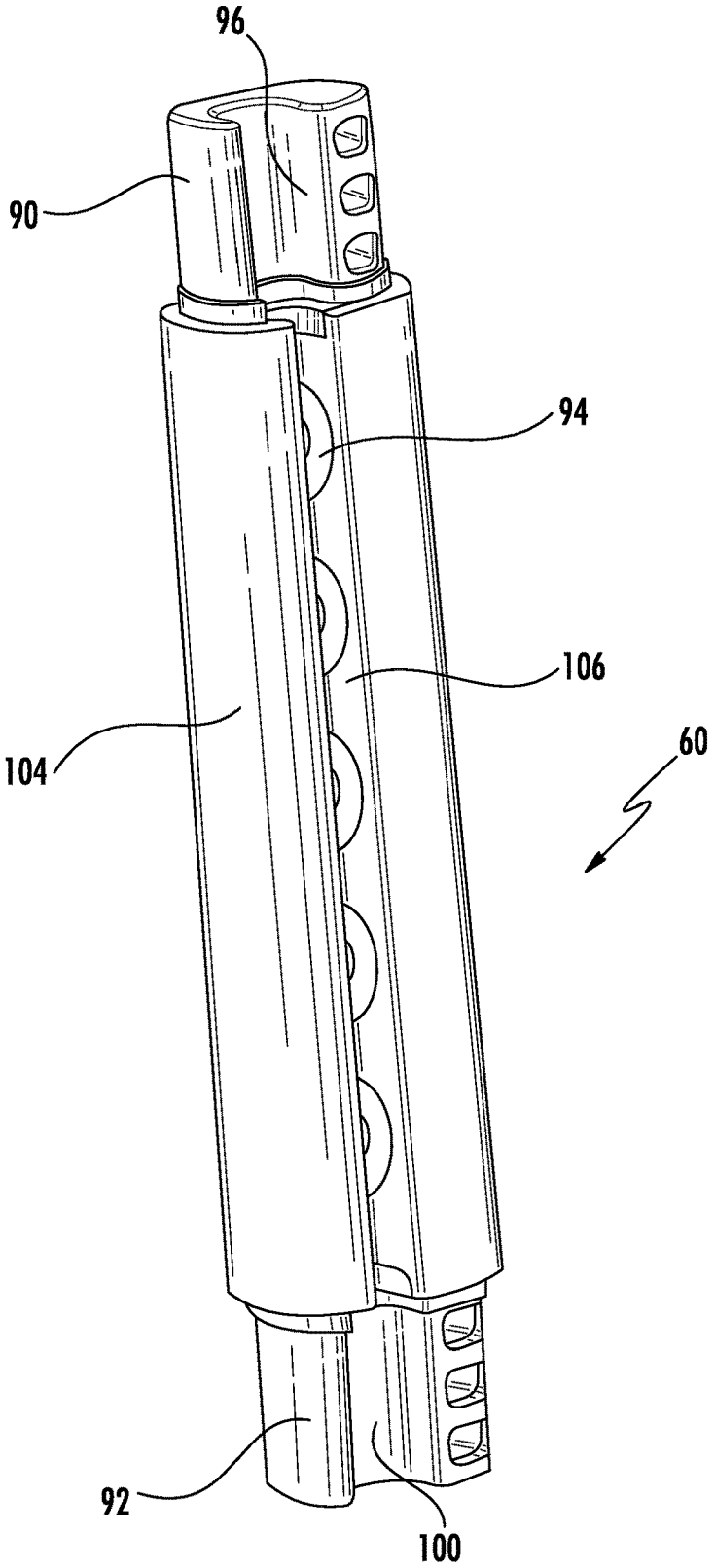
FIG. 5A is a perspective view of an embodiment of a flexible connector suitable for use with the chair shown in FIG. 1.
Figure 5B:
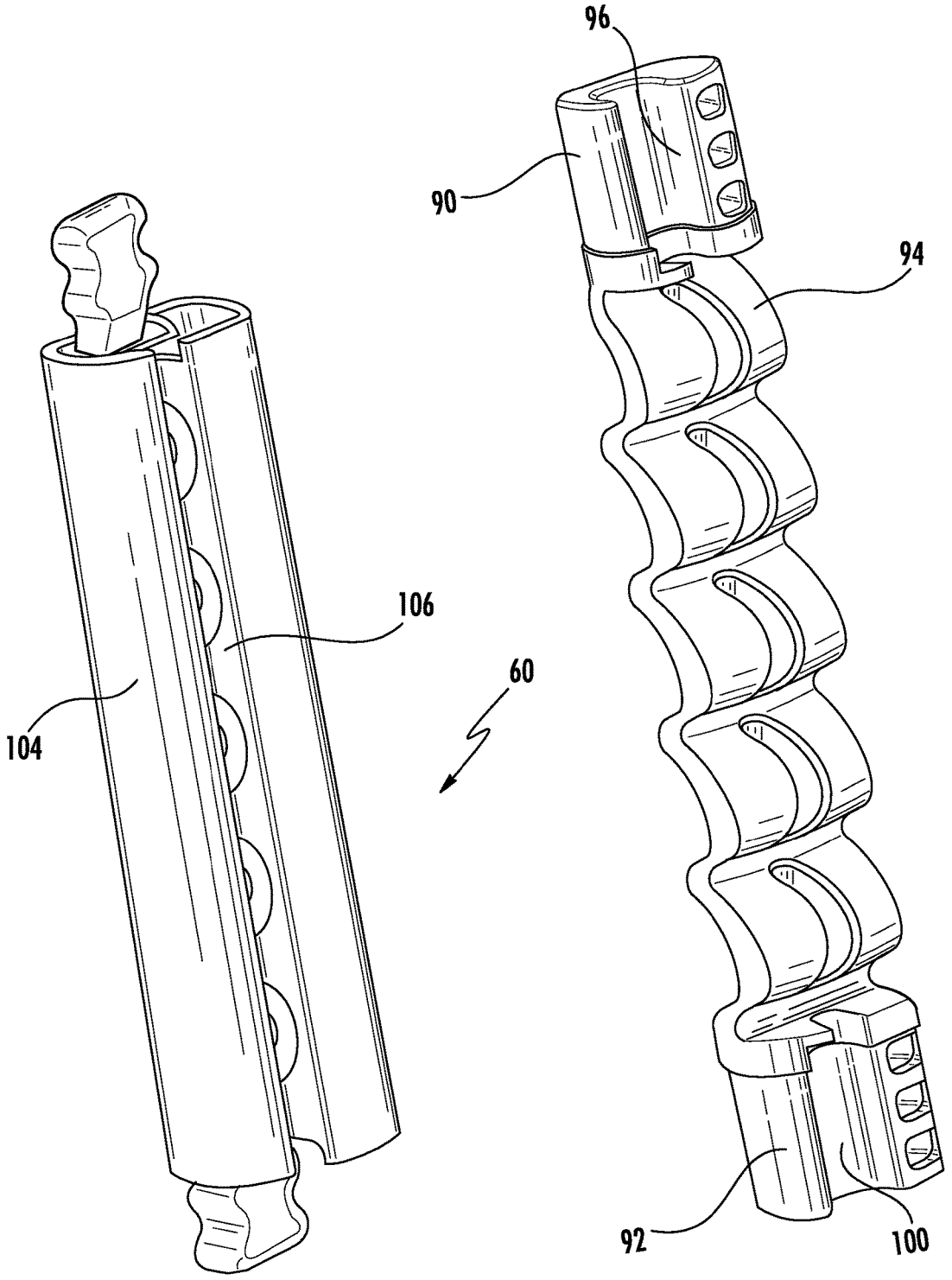
FIG. 5B is an exploded view of the embodiment of the flexible connector shown in FIG. 5A.
Figure 6:
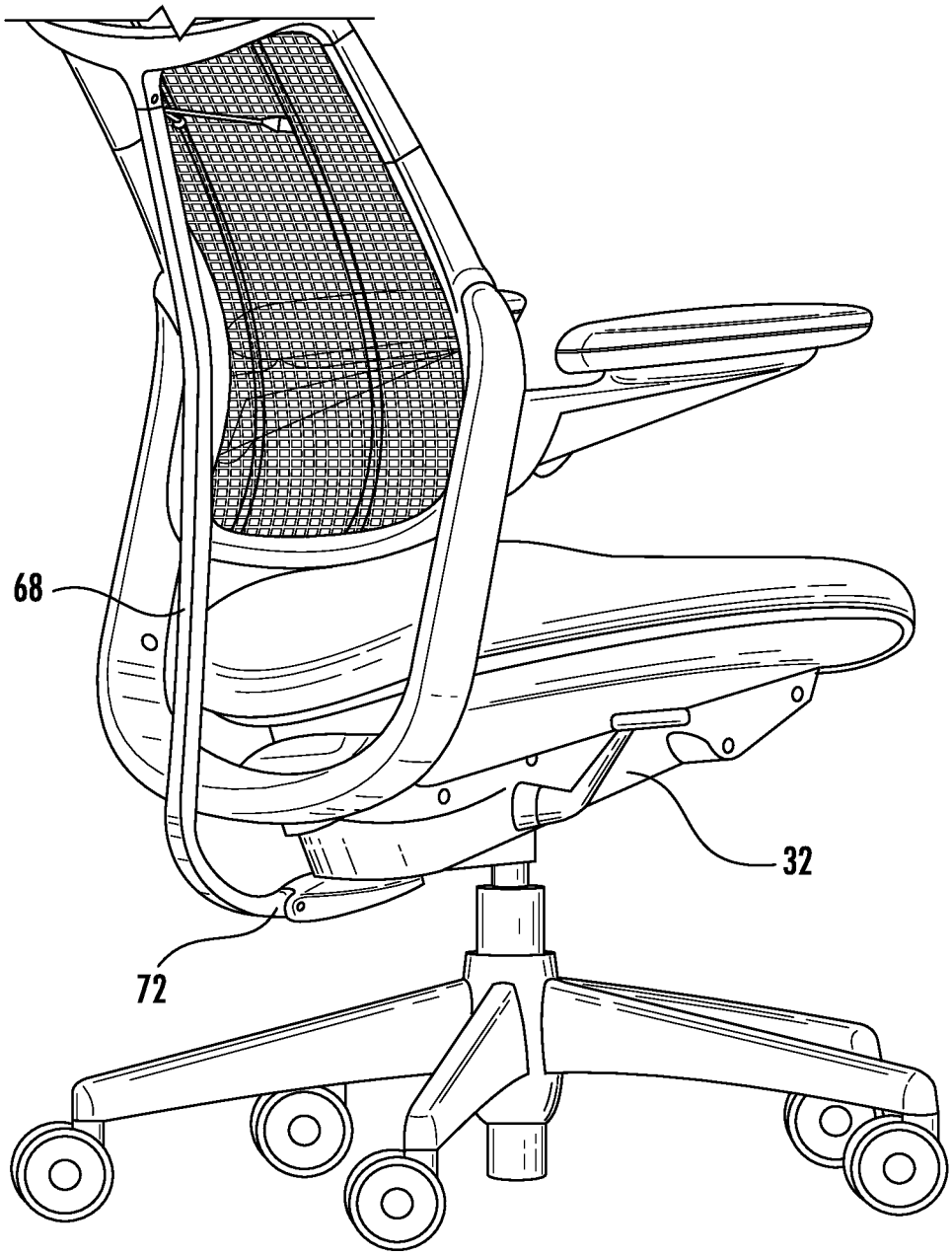
FIG. 6 is a perspective view showing an embodiment of a push arm suitable for use with the chair shown in FIG. 1.
Figure 7:
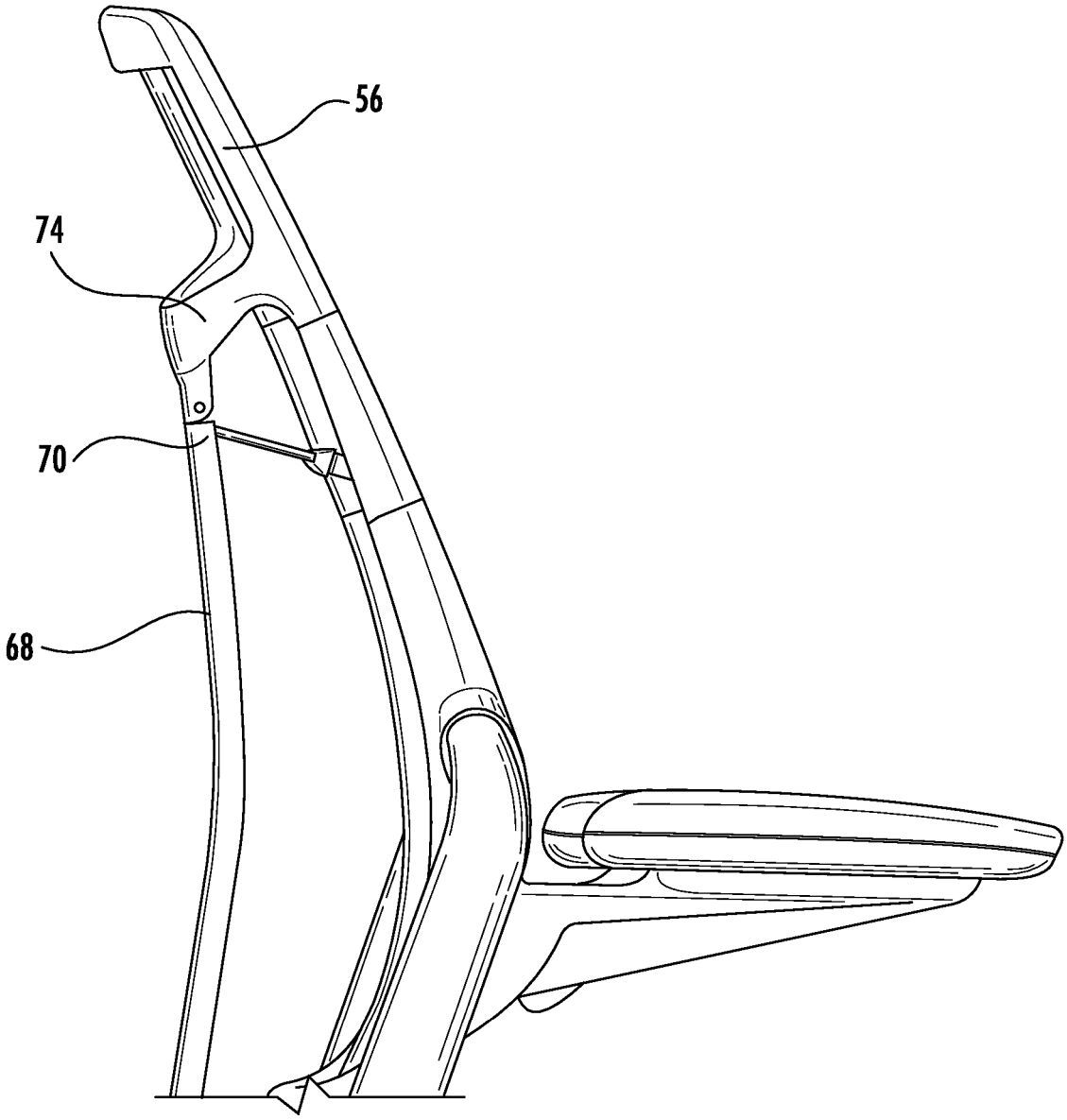
FIG. 7 is a side view showing the embodiment of the push arm shown in FIG. 6.

Referring now to FIGS. 4-5B, an embodiment of the articulated joints 60 are shown. In this depicted embodiment, the articulated joints 60 are flexible connectors 60. The flexible connector 60 is preferably configured to bend to allow the lower frame section 58 to move relative to the upper frame section 56. The flexible connectors 60 each include a sinusoidal member 94 including an upper junction 90 and a lower junction 92. The upper junction 90 may be dimensioned to fit into the upper frame section 56 to attach the flexible connector 60 to the lower end of upper frame section 56. The lower junction 92 may be dimensioned to fit into lower frame section 58 to attach the flexible connector 60 to the upper end of the lower frame 58.

Still referring to FIGS. 4-5B, the upper junction 90 may include a longitudinal recess 96 in one side. The lower junction 92 may include longitudinal recess 100 in one side. The longitudinal recess 96 may be aligned with the longitudinal recess 100. The flexible connector 60 may also include an outer sleeve 104 at least partially surrounding the sinusoidal member 94. The outer sleeve 104 may surround one, two, three, or all sides of sinusoidal member 94. In the embodiment shown in FIGS. 4-5B, the outer sleeve 104 includes a longitudinal opening 106 such that the outer sleeve 104 surrounds three sides of the sinusoidal member 94. The longitudinal opening 106 may be aligned with the longitudinal recesses 96 and 100 of the upper and lower junctions 90 and 92, respectively. With the flexible connector 60 attached between the upper and lower frames 56 and 58, the flexible connector 60 may be oriented such that the longitudinal opening 106 and the longitudinal recesses 96, 100 are positioned adjacent to mesh insert 40. In one embodiment, a portion of the mesh insert 40 may be disposed through the longitudinal opening 106 and the longitudinal recesses 96, 100 such that the opening and recesses serve as a guide for the mesh insert 40. When assembled, the longitudinal opening 106 and the longitudinal recesses 96, 100 may be oriented toward the front, outside, inside, or rear of the chair with a portion of the mesh insert 40 disposed therethrough. In one alternate embodiment, the outer sleeve 104 may surround the entirety of the sinusoidal member 94. In another alternate embodiment, the flexible connector 60 may include no outer sleeve 104 such that the sinusoidal member 94 is visible. The sinusoidal member 94 and the outer sleeve 104 may be formed of one or more flexible or elastomeric materials, for example, rubber, ethylene propylene diene rubber (EPDM), ethylene propylene rubber (EPM), hydrated acrylonitrile butadiene rubber (HNBR), a thermoplastic elastomer (TPE) (e.g., Veraflex™ or Hytrel®), elastolefin, polyethylene terephthalate (PET), polyethylene (PE), polyvinyl chloride (PVC), polypropylene (PP), polyurethanes (PU), polyetheretherketone (PEEK), polymethyl methacrylate (PMMA), polybutylene terephthalate (PBT) (e.g., Crastin®), or any other material capable of allowing lower frame section 58 to move independent of the upper frame section 56.

Figure 8:
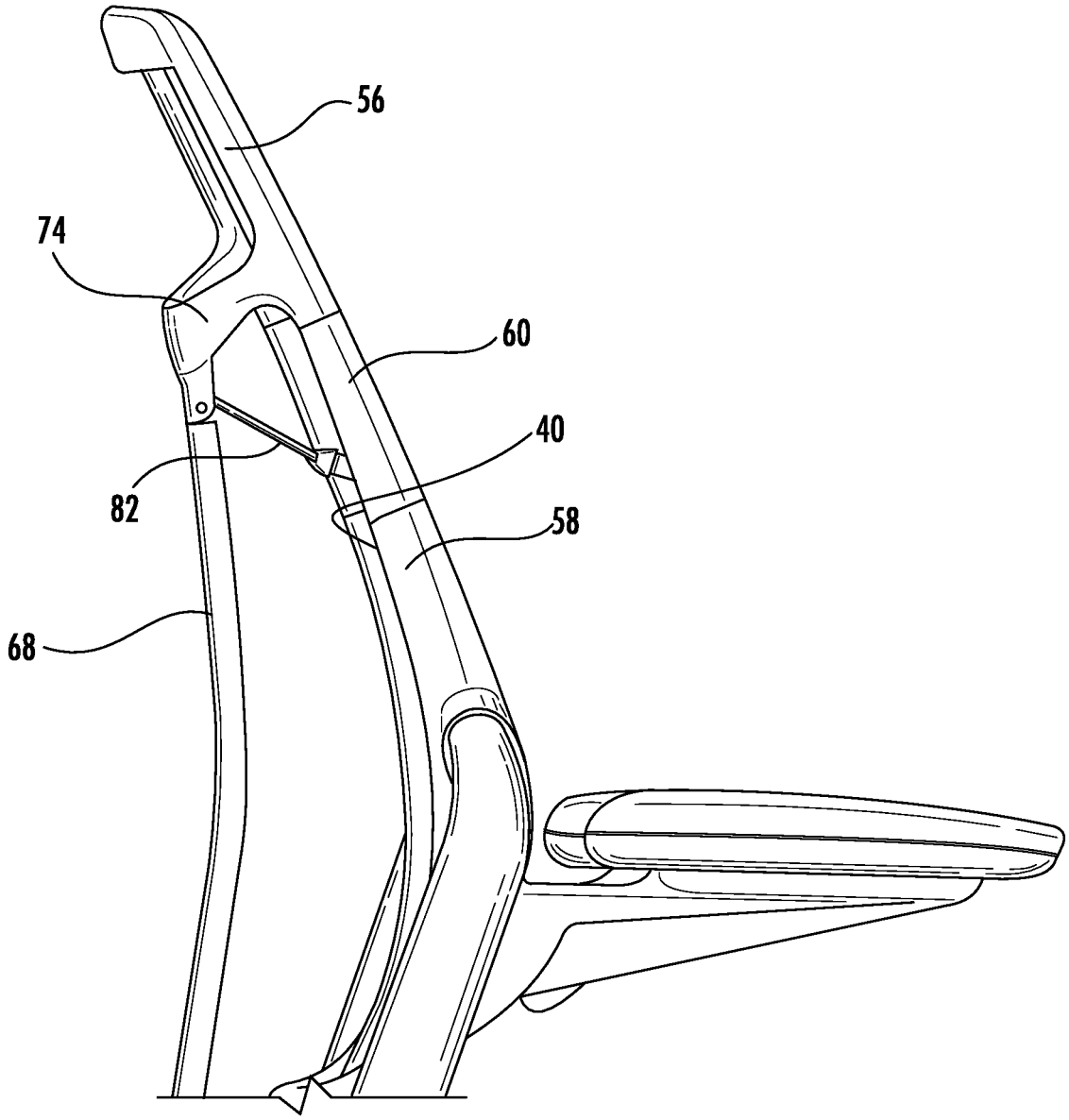
FIG. 8 is a side view showing an alternative embodiment of a chair having an articulating backrest in the upright position.

FIG. 8 illustrates an alternate embodiment in which there are two tension members 80, 82, and they are connected to the upper backrest brace 74 as opposed to the push arm 68 (see FIGS. 1-7). In this embodiment, the tension members 80, 82 function in the same way to maintain tension in the mesh insert 40 when the chair 10 is in the reclined state.

In another alternate embodiment, the push bar 68 may be routed between the seat assembly 14 and the backrest support 34. This embodiment may provide for a more compact design than the embodiment shown in FIGS. 1-8 in which the push arm 68 is routed outside of the backrest support 34.

The principles of the invention may be embodied in a chair having an upholstered articulating backrest. For example, the upholstered articulating backrest may include a single continuous upholstered backrest that deforms as it is reclined. In a reclined position, the angle between the upper portion and the lower portion of the upholstered backrest may decrease as described above in connection with the backrest 17. In another example, the upholstered articulating backrest may include separate upper and lower upholstered segments interconnected by a pair of flexible connectors at the left and right sides. The middle portions of the upper and lower upholstered segments (i.e., between the left and right sides) may be separated by a space. The lower upholstered segment may be reclined at a greater angle than the upper upholstered segment in the same way as backrest 17 described above.

The foregoing description and accompanying drawings illustrate the principles, exemplary embodiments, and modes of operation of the invention. However, the invention should not be construed as being limited to the particular embodiments discussed above. Many modifications of the embodiments described herein will come to mind to one skilled in the art having the benefit of the teaching presented in the foregoing descriptions and the associated drawings. Accordingly, it should be appreciated that variations to those embodiments can be made by those skilled in the art without departing from the scope of the invention.

What is claimed is:

1. A chair comprising:

a seat assembly including a seat;

a backrest assembly comprising an articulating backrest operatively connected to a backrest support, wherein the articulating backrest comprises a mesh insert secured to a frame, wherein the frame comprises an upper frame section and a lower frame section interconnected by a pair of articulated joints, and wherein the backrest support is pivotally connected to the seat assembly and pivotally connected to the lower frame section; and a push arm pivotally connected to the seat assembly and pivotally connected to the upper frame section such that the push arm causes the articulating backrest to deform as the chair is reclined.

2. The chair of claim 1, wherein the mesh insert comprises a unitary mesh insert secured to the upper frame section and the lower frame section.

3. The chair of claim 1, wherein the articulating backrest deforms when the chair reclines to decrease an angle between the upper frame section and the lower frame section, wherein a line substantially parallel to the upper frame section and a line substantially parallel to the lower frame section intersect at an intersection point to form the angle.

4. The chair of claim 3, further comprising a tension member having a first end secured to the upper frame section and a second end secured to the mesh insert to maintain tension in the mesh insert when the chair is in a reclined state.

5. The chair of claim 3, further comprising a tension member having a first end secured to an upper end of the push arm and a second end secured to the mesh insert to maintain tension in the mesh insert when the chair is in a reclined state.

6. The chair of claim 5, further including a second tension member having a first end secured to an upper end of the push arm and a second end secured to the mesh insert.

7. The chair of claim 6, wherein the mesh insert includes a first mesh panel, a second mesh panel, a third mesh panel, a first seam interconnecting the first mesh panel and the second mesh panel, and a second seam interconnecting the second mesh panel and the third mesh panel, and wherein the second end of the tension member is attached to the first seam and the second end of the second tension member is attached to the second seam.

8. The chair of claim 5, wherein the pair of articulated joints each comprises a flexible connector.

9. The chair of claim 8, wherein each of the flexible connectors comprises a longitudinal recess having a portion of the mesh insert disposed therein.

10. The chair of claim 8, wherein each of the flexible connectors comprises a sinusoidal member formed of a flexible material.

11. The chair of claim 10, wherein the sinusoidal member is at least partially housed within a sleeve.

12. The chair of claim 5, wherein the backrest support comprises a U-shaped member having a base and two ends, wherein the base is pivotally connected to the seat assembly and each of the ends is pivotally connected to the lower frame section of the articulating backrest.

13. A chair comprising:

a seat assembly;

a backrest assembly comprising an articulating backrest operatively connected to a backrest support, wherein the articulating backrest includes a mesh insert secured to a frame, wherein the frame comprises an upper frame section and a lower frame section interconnected by a pair of articulated joints, and wherein the backrest support is pivotally connected to the seat assembly and pivotally connected to the lower frame section; and a push arm pivotally connected to the seat assembly and pivotally connected to the upper frame section such that the push arm causes the articulating backrest to deform as the chair is reclined.

14. The chair of claim 13, wherein the articulating backrest deforms when the chair reclines to decrease an angle between the upper frame section and the lower frame section, wherein a line substantially parallel to the upper frame section and a line substantially parallel to the lower frame section intersect at an intersection point to form the angle.

15. The chair of claim 14, further comprising a tension member having a first end secured to an upper end of the push arm and a second end secured to the mesh insert to maintain tension in the mesh insert when the chair is in a reclined state.

16. The chair of claim 15, wherein the pair of articulated joints each comprises a flexible connector.

17. The chair of claim 16, wherein each of the flexible connectors comprises a longitudinal recess having a portion of the mesh insert disposed therein.

18. The chair of claim 16, wherein each of the flexible connectors comprises a sinusoidal member formed of a flexible material.

19. The chair of claim 18, wherein the sinusoidal member is at least partially housed within a sleeve.

20. A chair comprising:

a seat assembly;

a backrest assembly pivotally connected to the seat assembly, the backrest assembly comprising an articulating backrest having a mesh insert secured to a frame, wherein the frame comprises an upper frame section and a lower frame section interconnected by a pair of articulated joints;

a push arm pivotally connected to the seat assembly and pivotally connected to the upper frame section such that the push arm causes the articulating backrest to deform as the chair is reclined; and a tension member secured to the push arm and the mesh insert to maintain tension in the mesh insert when the chair is reclined.

21. The chair of claim 20, wherein the articulating backrest deforms when the chair reclines to decrease an angle between the upper frame section and the lower frame section, wherein a line substantially parallel to the upper frame section and a line substantially parallel to the lower frame section intersect at an intersection point to form the angle.

22. The chair of claim 21, wherein the pair of articulated joints each comprises a flexible connector.

23. The chair of claim 22, wherein each of the flexible connectors comprises a longitudinal recess having a portion of the mesh insert disposed therein.

24. The chair of claim 22, wherein each of the flexible connectors comprises a sinusoidal member formed of a flexible material.

* * * * *